US006315079B1

(12) United States Patent
Berends et al.

(10) Patent No.: US 6,315,079 B1
(45) Date of Patent: Nov. 13, 2001

(54) LIFTING DEVICE WITH MOVABLE LIFTING COLUMNS

(75) Inventors: Jan Berends; Jurjen Jan De Jong, both of Buitenpost (NL)

(73) Assignee: Stertil B.V., Kootstertille (NL)

( * ) Notice: Subject to any disclaimer, the term of this patent is extended or adjusted under 35 U.S.C. 154(b) by 0 days.

(21) Appl. No.: 09/341,832

(22) PCT Filed: Jan. 8, 1998

(86) PCT No.: PCT/NL98/00014

§ 371 Date: Sep. 15, 1999

§ 102(e) Date: Sep. 15, 1999

(87) PCT Pub. No.: WO98/30488

PCT Pub. Date: Jul. 16, 1998

(30) Foreign Application Priority Data

Jan. 8, 1997 (NL) ..... 1004956

(51) Int. Cl.[7] ..... B66F 3/46; B66F 7/28

(52) U.S. Cl. ..... 187/210; 187/203; 187/219; 254/89 H; 414/427; 414/458

(58) Field of Search ..... 187/203, 210, 187/216, 219, 220, 274, 285; 375/355, 356; 340/870.16, 870.19, 310.06; 414/426, 427, 255, 256, 458; 254/89 H

(56) References Cited

U.S. PATENT DOCUMENTS 5,800,114 * 9/1998 Secondi ..... 414/458

* cited by examiner

*Primary Examiner*—Eileen D. Lillis
*Assistant Examiner*—Paul T. Chin
(74) *Attorney, Agent, or Firm*—Crowell & Moring LLP

(57) ABSTRACT

A lifting device having separately displaced lifting column with a carriage controllably driven in a longitudinal direction. Connecting lines connect the control of the column. The connecting lines function as part of a digital data bus in order to exchange digital control signals with each lifting column having a separate operation device connected to the connecting lines to provide simultaneous actuation of the control of all lifting columns.

19 Claims, 3 Drawing Sheets

LIFTING DEVICE WITH MOVABLE LIFTING COLUMNS

FIELD OF THE INVENTION

The invention relates to a vehicle lift which comprises at least two separately displaceable lifting columns.

BACKGROUND OF THE INVENTION

Such a vehicle lift is known from AT-A-325,811 and is used particularly for lifting heavy vehicles, such as cars, trucks and buses.

The signals required to cause all lifting columns to operate as a unit are transmitted along separate connecting lines. These signals comprise activating signals for switching on and off the drive means of each lifting column and also monitoring signals for comparing the lifting height of each lifting column. The lifting columns are thus mutually coupled by the connecting lines to form one lifting device which functions in substantially the same manner as a customary vehicle lift.

SUMMARY OF THE INVENTION

The invention has for its object to further develop the known vehicle lift in order to give it more application options.

The lifting columns are hereby no longer considered as composite parts of a whole device but as separate devices which co-act in random numbers. With the invention is achieved that a wide diversity of control and monitoring signals can be exchanged between the separate lifting columns mutually and with the operating means, whereby the options for use of the lifting device according to the invention are greatly increased.

It is remarked here, that European patent application 0,747,535 relates to a lifting device with at least two lifting columns, where the connecting lines are a data base for exchange of control signals. However, this publication relates to transport of a building, where the lifting columns are necessarily displaceable, when a load is resting thereupon. Also, simultaneous actuation of the lifting columns is not an issue, but keeping the loads on each lifting column below a predetermined maximum is. Further, the structural requirements on a system for lifting and transporting a building, and the forces, which need to be generated in doing so, are considerably greater or higher than those in the case of a vehicle lift according to the present invention.

Communicating the safety signals via the data bus ensures that a random number of co-acting lifting columns can co-act reliably and, in particular, with great safety.

The CAN data bus and components therefor are well standardized, so that the control and operating means can be constructed and embodied in reliable manner. Because this data bus only requires two wires, the connecting lines remain well manageable and little vulnerable.

The proper operation of all lifting columns can be ascertained from the operating means whereby control signals for setting the safety means into operation can be transmitted in one direction in the closed circuit, which results in a high reliability.

User can select the lifting column which is most suitable for him for the operation of the whole device.

The energy supply for each, or at least a number of the lifting columns can take place via the at least one lifting column. It is possible for instance to dimension the supply voltage lines such that a total of four lifting columns are supplied via the one lifting column. The at least one lifting column can herein be provided with overload protection means which ensure switching off of the power supply in the case of overload of several or all coupled lifting columns.

According to another suitable embodiment the relative position of each lifting column is easily identifiable by the operating means.

The lifting columns which are disposed on either side of the same vehicle axle as pairs. It hereby becomes possible, when a vehicle is supported by more than four lifting columns, for instance to build in or remove an axle by independently operating the two lifting columns forming part of one pair.

Separate operation of the lifting columns mutually associated to form a pair can be performed in simple manner from the operating means.

After adjustment of one of the pairs, the other co-acting pairs can be identified simply by the operating means.

BRIEF DESCRIPTION OF THE DRAWINGS

The invention is further elucidated in the following description with reference to the annexed figures.

DETAILED DESCRIPTION OF THE PREFERRED EMBODIMENT

Figure 1:
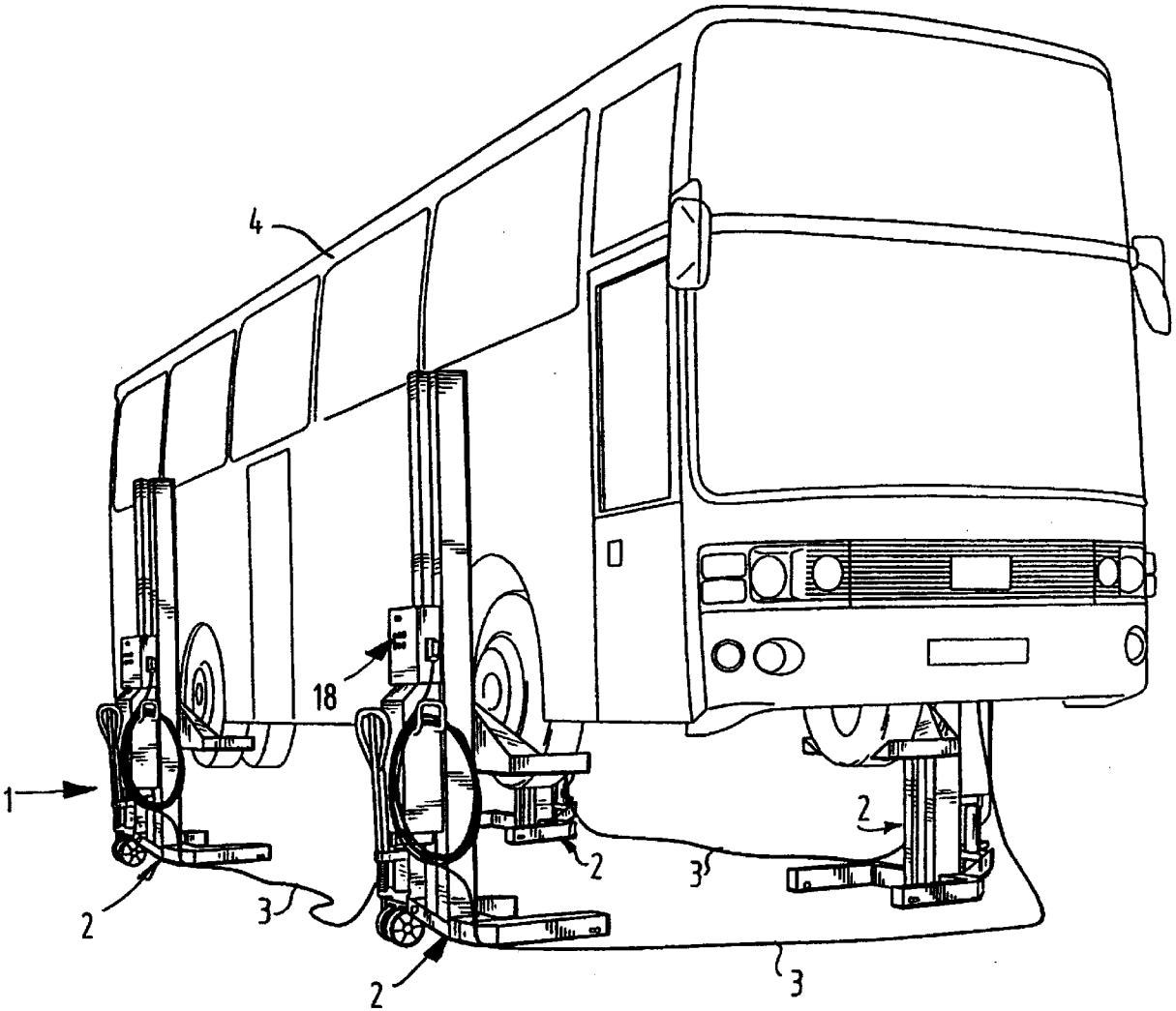
FIG. 1 shows a lifting device of the present type in the position of use.

The lifting device 1 according to the invention shown in FIG. 1 comprises four separately displaceable lifting columns 2 which co-act to lift a bus 4. For the co-action the lifting columns 2 are mutually coupled by means of connecting lines 3 which form part of a digital data bus of the CAN type.

Figure 2:
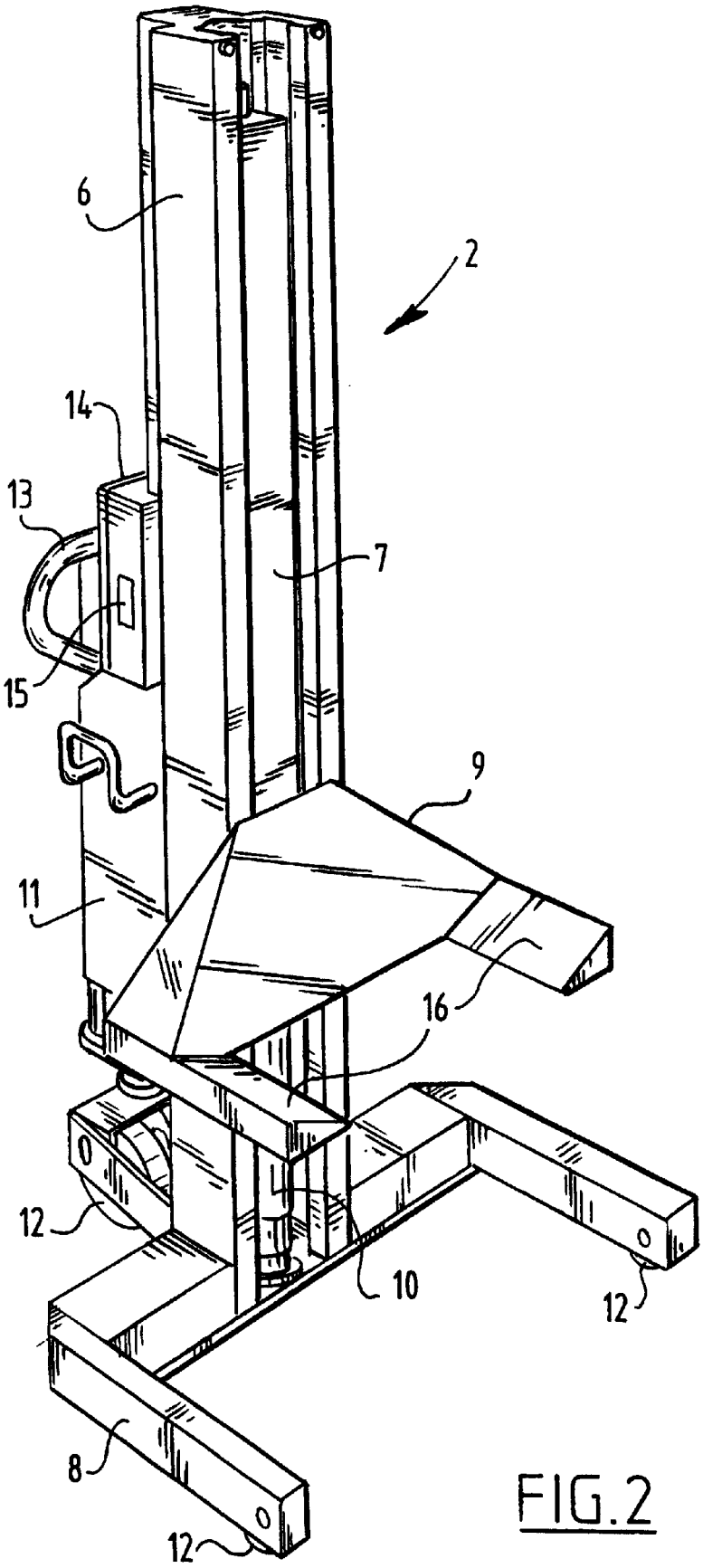
FIG. 2 shows a lifting column of the lifting device of FIG. 1.

As shown in FIG. 2, each lifting column 2 comprises a column 6 in which a carriage 7 is guided slidably in longitudinal direction. On the bottom end of column 6 is arranged a support foot 8 with which the column can be deployed stably on a ground surface.

Carriage 7 bears on its lower end a lifting member 9 which is provided with two protrusions 16 which can engage around a vehicle wheel. Carriage 7 can be displaced in column 6 by means of drive means in the form of a hydraulic cylinder 10. This hydraulic cylinder 10 is fed with hydraulic oil under pressure from a hydraulic unit 11, which is per se known and not shown in detail. Such a hydraulic unit 11 comprises a hydraulic pump driven by an electric motor, which can draw hydraulic oil out of a reservoir and press it under pressure into cylinder 10 in order to move the carriage 7 upward.

Control of hydraulic unit 11 takes place with per se known control means which are accommodated in a box 14 on lifting column 2.

In order to enable displacement of lifting column 2 and positioning with protrusions 16 on either side of a vehicle wheel, the lifting column 2 is provided with wheels 12. These wheels 12 form together with push-bar 13 a mechanism which is per se known for pallet trucks. By moving push-bar 13 up and downward in pumping manner the wheels 12 can be moved downward relative to support foot 8 whereby lifting column 2 becomes displaceable on wheels 12. By operating a hydraulic valve the wheels 12 are retracted, whereby support foot 8 comes to lie on the ground.

In the mobile situation the lifting column 2 can be manoeuvred using push-bar 13.

Control means 14 comprise per se known switching means for switching on and off hydraulic unit 11. This switch-on/off command is given by activating the operating means 18. Control means 14 for each lifting column 2 and the operating means 18 are embodied such that they can exchange signals via the connecting lines 3.

Figure 3:
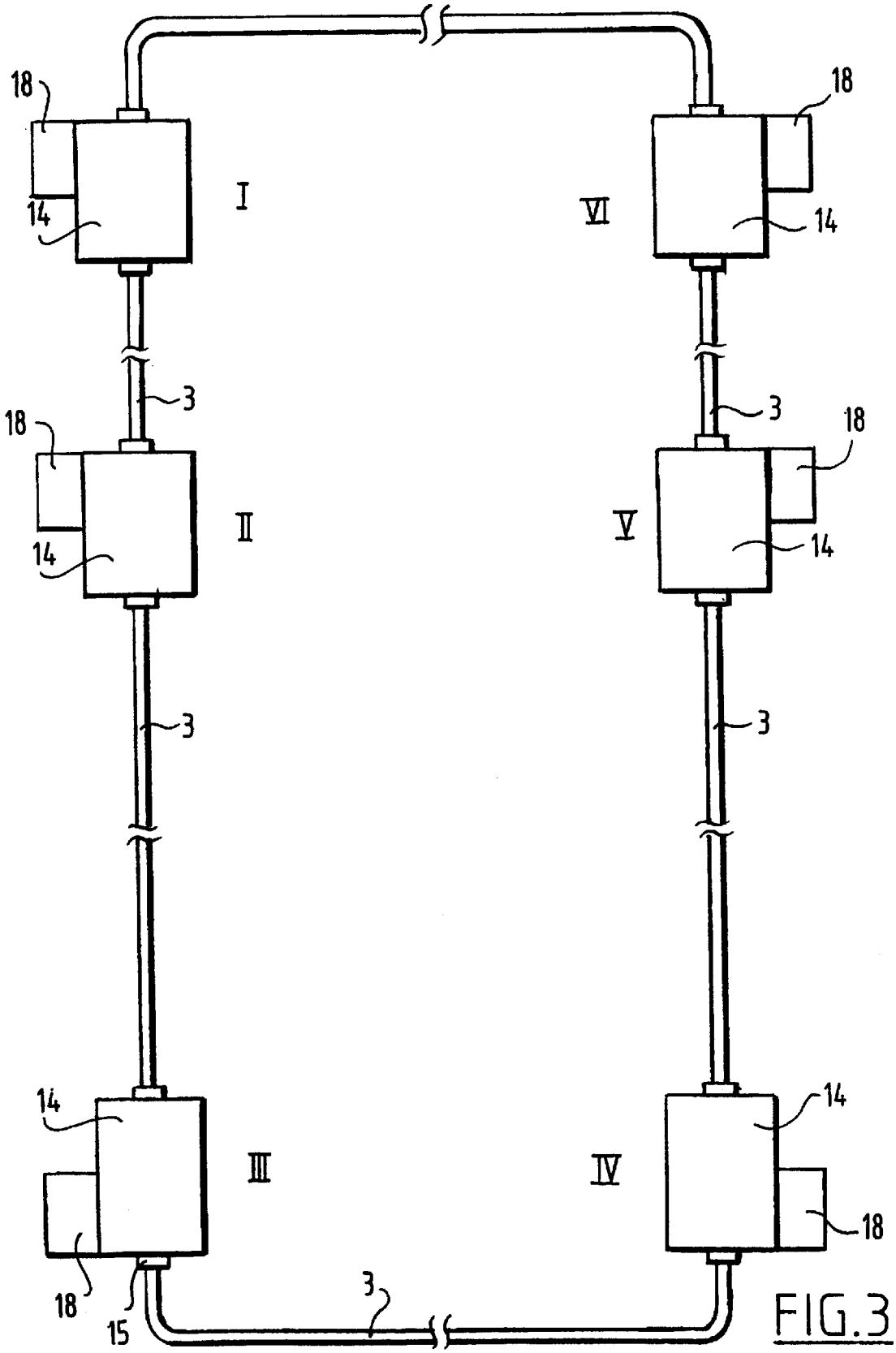
FIG. 3 shows schematically six lifting columns mutually coupled by connecting lines.

As shown in FIG. 1, each of the lifting columns is provided with a length of line 3 which carries on its end a connector which is connected to a connector terminal 15 of an adjacent lifting column 2. Control means 14 and operating means 18 are thus connected in a series as shown in FIG. 3 for a lifting device comprising six lifting columns.

In the shown embodiment two conductors in connecting lines 3 form parts in each case of a digital CAN data bus. Connecting lines 3 can further comprise conductors for the supply current of the hydraulic units.

Because the control means and operating means are mutually coupled by means of the CAN data bus, a variety of signals can be sent to and from each lifting column. For a good co-action with the CAN data bus the control means are based on a microprocessor, so that the different options can be entered by programming.

A suitable possibility, which can be applied particularly when more than four lifting columns are used, is to cause determined lifting columns to be raised and lowered independently. The two lifting columns deployed on either side of an axle of a vehicle can for instance be jointly moved upward and downward, while others retain the adjusted height, for the purpose of changing a vehicle axle.

For this purpose a serial number is assigned to each of the lifting columns for addressing the control signals. In FIG. 3 these serial numbers are designated schematically with I–VI. Assigning of these serial numbers can take place simply after arranging connecting lines 3. operating means 18 can perform a program-controlled query over the data bus in order to establish how many lifting columns are connected to the data bus and subsequently assign the serial number to each of these lifting columns. The software can be embodied such that the lifting columns associated in each case with one axle are then mutually associated to form independently operable pairs. In the diagram of FIG. 3 the lifting columns designated II and V can for instance be operated in suitable manner as a separate pair in order to move an axle supported by these lifting columns separately upward and downward.

FIG. 3 shows that each column bears operating means 18, so that the whole lifting device can be operated at each column. It is also possible to embody the operating means 18 as a separate unit which can exchange signals with control means 14 via a cable connection. The cable connection can for instance be made as required with a random column.

As shown in FIG. 3, the connecting lines 3 are connected in a closed circuit, wherein one lifting column in each case is connected to a subsequent one. Control and safety signals can hereby be fed back via the closed circuit to the operational operating means 18, whereby monitoring of the proper operation of all connected columns becomes possible and the data flow can for instance take place in one direction, which results in a simple and therefore reliable embodiment.

Mutually associating determined lifting columns to form an independently operable pair can also take place in a less well developed embodiment of the invention in that an operator enters data concerning the co-acting columns into the control means. Each lifting column can thus be provided with an independently actuable adjusting member which, after actuation, places the device in a learning mode. If within a determined time after actuation of the adjusting member on one column a corresponding adjusting member on another column is actuated, the control device will mutually associate these two columns to form an independently operable pair.

The invention is not limited to the embodiments shown in the figures and described above. Through use of the digital data bus in combination with suitable programming of the control and operating means a lifting device can be given the functionality desired for a particular application.

What is claimed is:

1. A lifting device, comprising:

at least two separately displaceable lifting columns;

a carriage associated with each of said lifting columns wherein said carriage is guided slidably in a longitudinal direction of the column;

drive means for displacing the carriage in a longitudinal direction relative to the column;

control means for controlling the drive means;

connecting lines for connecting the control means of the respective columns wherein said connecting lines form part of a digital data bus and wherein the control means are adapted to exchange digital control signals through said data bus and wherein each of said at least two lifting columns includes an operating means connected to the connecting lines for at least simultaneous actuation of the control means of all lifting columns.

2. The lifting device as claimed in claim 1, wherein each said lifting column comprises safety means for switching off the drive means on activation thereof, wherein the safety means likewise exchange digital control signals via the date bus.

3. The lifting device as claimed in claim 1, wherein the digital data bus is of the two-wire CAN type.

4. The lifting device as claimed in claim 1, wherein all said lifting columns are connected by the connecting lines in a closed circuit.

5. The lifting device as claimed in claim 1, wherein each said lifting column comprises operating means for switching on specific control means of a lifting column as operating means for the whole lifting device.

6. The lifting device as claimed in claim 1, wherein at least one said lifting column is provided with an electrical power supply connection and at least one lifting column is not, and the connecting lines comprise electrical supply lines.

7. The lifting device as claimed in claim 1, wherein the operating and control means are adapted such that, after arranging of the connecting means a serial number intended for addressing of the control signals is assigned to each of the lifting columns by a program-controlled query.

8. The lifting device as claimed in claim 1, wherein the operating and control means comprise adjusting members for mutually associating determined lifting columns to form independently operable pairs.

9. The lifting device as claimed in claim 1, where each said lifting column comprises a column provided with a support foot, a carriage guided slidably in longitudinal direction of this column and a lifting member arranged on a foot end of the carriage.

10. The lifting device as claimed in claim 7, wherein the adjusting members mutually associate determined lifting columns by recording in the control means the respective serial numbers of the mutually associated lifting columns.

11. The lifting device as claimed in claim 10, wherein said lifting columns of each of the mutually associated lifting columns standing adjacently in a determined direction are mutually associated to form an independently operable pair.

12. A lifting device, comprising:

at least two lifting columns which are separately displaceably in an unloaded state, each of said columns provided with a support foot;

a carriage guided slidably in a longitudinal direction of a respective column;

a lifting member arranged on one end of said carriage;

drive means for displacing said carriage in a longitudinal direction relative to the column;

control means for controlling said drive means;

connecting lines for connecting the control means of the columns;

operating means connected to the connecting lines for at least simultaneous actuation of the control means of each of said listing column wherein said connecting lines form part of a two-wire CAN digital data bus and wherein the operating means and the control means are adapted to exchange signals through said CAN type digital bus.

13. The lifting device according to claim 12, wherein each said lifting column comprises safety means for switching off the drive means, wherein the safety means exchanges digital control signals via the data bus.

14. The vehicle lifting device according to claim 12 wherein all said lifting columns are connected by the connecting lines in a closed circuit.

15. A lifting device as claimed in claim 12, wherein each said lifting column comprises operating means for switching on specific control means of a lifting column as operating means for the entire lifting device.

16. A lifting device, comprising:

at least two lifting columns which are separately displaceably in an unloaded state, each of said columns provided with a support foot;

a carriage guided slidably in a longitudinal direction of a respective column;

a lifting member arranged on one end of said carriage;

drive means for displacing said carriage in a longitudinal direction relative to the column;

control means for controlling said drive means;

connecting lines for connecting the control means of the columns;

operating means connected to the connecting lines for at least simultaneous actuation of the control means of each of said listing column wherein said connecting lines form part of a digital data bus and wherein the operating means and the control means are adapted to exchange signals through said type digital bus, wherein the operating and control means are adapted so that, after arranging of the connecting means, the operating means and the control means assigned to each of the lifting columns a serial number intended for addressing of the control signals.

17. A lifting device, comprising:

at least two lifting columns which are separately displaceably in an unloaded state, each of said columns provided with a support foot;

a carriage guided slidably in a longitudinal direction of a respective column;

a lifting member arranged on one end of said carriage;

drive means for displacing said carriage in a longitudinal direction relative to the column;

control means for controlling said drive means;

connecting lines for connecting the control means of the columns;

operating means connected to the connecting lines for at least simultaneous actuation of the control means of each of said listing column wherein said connecting lines form part of a digital data bus and wherein the operating means and the control means are adapted to exchange signals through said type digital bus, wherein the operating and control comprise adjusting members for mutually associating determined lifting columns to form independent operable pairs.

18. The lifting device as claimed in claim 17, wherein the adjusting members mutually associate determined lifting columns by recording in the control means the respective serial numbers of the mutually associated lifting columns.

19. The lifting device as claimed in claim 18, wherein said lifting columns of each of the mutually associated lifting columns standing adjacent in a determined direction are mutually associated to form an independent operable pair.

* * * * *

US006315079C1

(12) EX PARTE REEXAMINATION CERTIFICATE (9780th)

United States Patent

Berends et al.

(10) Number: US 6,315,079 C1

(45) Certificate Issued: Jul. 31, 2013

(54) LIFTING DEVICE WITH MOVABLE LIFTING COLUMNS

(75) Inventors: Jan Berends, Buitenpost (NL); Jurjen Jan De Jong, Buitenpost (NL)

(73) Assignee: Stertil B.V., Kootstertille (NL)

Reexamination Request:
No. 90/012,088, Jan. 11, 2012

Reexamination Certificate for:

| | |
|---|---|
| Patent No.: | **6,315,079** |
| Issued: | **Nov. 13, 2001** |
| Appl. No.: | **09/341,832** |
| Filed: | **Sep. 15, 1999** |

(21) Appl. No.: 90/012,088

(22) PCT Filed: Jan. 8, 1998

(86) PCT No.: PCT/NL98/00014

§ 371 (c)(1), (2), (4) Date: Sep. 15, 1999

(87) PCT Pub. No.: WO98/30488

PCT Pub. Date: Jul. 16, 1998

(30) Foreign Application Priority Data

Jan. 8, 1997 (NL) ..... 1004956

(51) Int. Cl.
*B66F 3/46* (2006.01)
*B66F 7/28* (2006.01)

(52) U.S. Cl.
USPC ..... 187/210; 187/203; 187/219; 254/89 H; 414/427; 414/458

(58) Field of Classification Search
None
See application file for complete search history.

(56) References Cited

To view the complete listing of prior art documents cited during the proceeding for Reexamination Control Number 90/012,088, please refer to the USPTO's public Patent Application Information Retrieval (PAIR) system under the Display References tab.

*Primary Examiner* — Russell Stormer

(57) ABSTRACT

A lifting device having separately displaced lifting column with a carriage controllably driven in a longitudinal direction. Connecting lines connect the control of the column. The connecting lines function as part of a digital data bus in order to exchange digital control signals with each lifting column having a separate operation device connected to the connecting lines to provide simultaneous actuation of the control of all lifting columns.

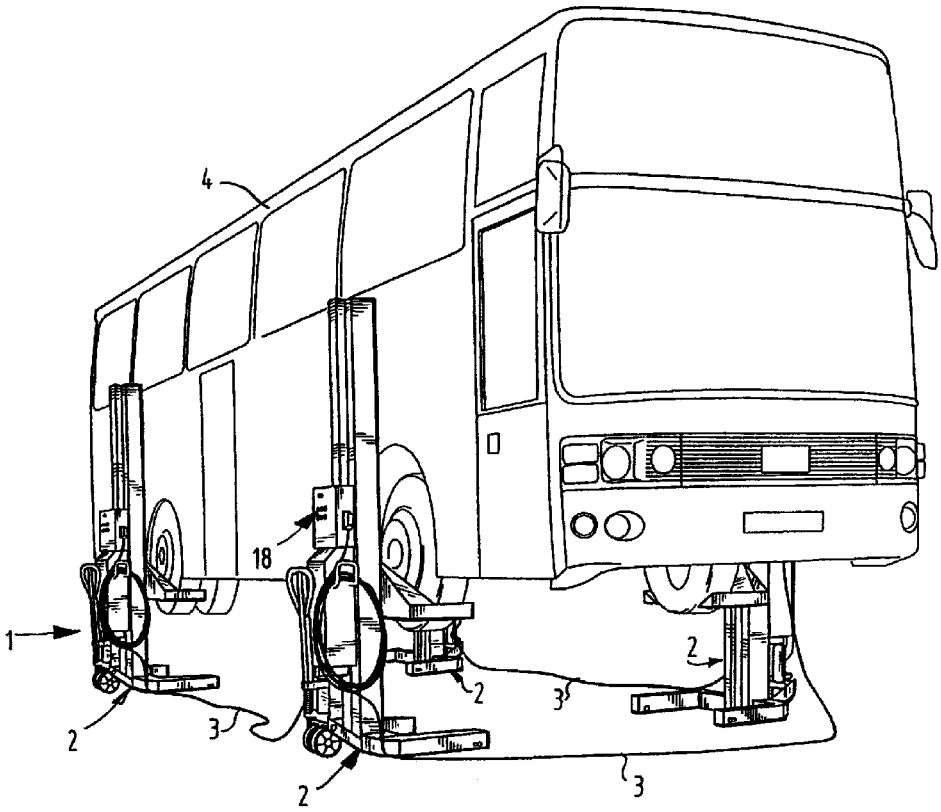

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 4 is cancelled.

Claims 1, 2, 9, 12, 14, 16, 17 and 18 are determined to be patentable as amended.

Claims 3, 5-8, 10, 11, 13, 15 and 19, dependent on an amended claim, are determined to be patentable.

1. A lifting device, comprising:

at least two separately displaceable lifting columns;

a carriage associated with each of said lifting columns wherein said carriage is guided slidably in a longitudinal direction of the column;

drive means for displacing the carriage in a longitudinal direction relative to the column;

control means for controlling the drive means;

connecting lines for connecting the control means of the respective columns wherein said connecting lines form part of a digital data bus and wherein the control means are adapted to exchange digital control signals through said data bus and wherein each of said at least two lifting columns includes an operating means connected to the connecting lines for at least simultaneous actuation of the control means of all lifting columns *and wherein said control means for each lifting column and said operating means are configured to exchange signals via said connecting lines*.

2. The lifting device as claimed in claim 1, wherein each *of* said lifting [column] *columns* comprises safety means for switching off the drive means on activation thereof, wherein the safety means likewise exchange digital control signals via the [date] *data* bus.

9. The lifting device as claimed in claim 1, [where] *wherein* each said lifting column comprises a column provided with a support foot, a carriage guided slidably in *a* longitudinal direction of this column and a lifting member arranged on a foot end of the carriage.

12. A lifting device, comprising:

at least two lifting columns which are separately displaceably in an unloaded state, *wherein* each of said columns *is* provided with[a]*:*

*a* support foot[;], a carriage guided slidably in a longitudinal direction of a respective column[;], a lifting member arranged on one end of said carriage[;], drive means for displacing said carriage in a longitudinal direction relative to the column[;], control means for controlling said drive means[;], *and operating means; and the lifting device includes* connecting lines for connecting the control means of the columns[;],

*wherein the* operating means *of each lifting column is* connected to the connecting lines for at least simultaneous actuation of the control means of each of said [listing column] *lifting columns* wherein said connecting lines form part of a two-wire CAN digital data bus and wherein the operating means and the control means are adapted to exchange signals through said CAN type digital bus *and wherein said control means for each lifting column and said operating means are configured to exchange signals via said connecting lines*.

14. The vehicle lifting device according to claim 12, wherein all said lifting columns are connected by the connecting lines in a closed circuit.

16. A lifting device, comprising:

at least two lifting columns which are separately displaceably in an unloaded state, *wherein* each of said columns *is* provided with*:* a support foot[;], a carriage guided slidably in a longitudinal direction of a respective column[;], a lifting member arranged on one end of said carriage[;], drive means for displacing said carriage in a longitudinal direction relative to the column[;], control means for controlling said drive means[;], *and operating means, and the lifting device includes* connecting lines for connecting the control means of the columns[;],

*wherein the* operating means *of each lifting column is* connected to the connecting lines for at least simultaneous actuation of the control means of each of said [listing column] *lifting columns* wherein said connecting lines form part of a digital data bus and wherein the operating means and the control means are adapted to exchange signals through said type digital bus, wherein the operating *means* and control means are adapted so that, after arranging of the connecting means, the operating means and the control means assigned to each of the lifting columns a serial number intended for addressing of the control signals *and wherein said control means for each lifting column and said operating means are configured to exchange signals via said connecting lines*.

17. A lifting device, comprising:

at least two lifting columns which are separately displaceably in an unloaded state, *wherein* each of said columns *is* provided with*:* a support foot[;], a carriage guided slidably in a longitudinal direction of a respective column[;], a lifting member arranged on one end of said carriage[;], drive means for displacing said carriage in a longitudinal direction relative to the column[;], control means for controlling said drive means[;], *and operating means; and wherein the lifting device includes* connecting lines for connecting the control means of the columns[;],

*wherein the* operating means *of each of the lifting columns is* connected to the connecting lines for at least simultaneous actuation of the control means of each of said [listing column] *lifting columns* wherein said connecting lines form part of a digital data bus and wherein the operating means and the control means are adapted to exchange signals through said type digital bus, wherein the operating and control *means* comprise adjusting members for mutually associating determined lifting columns to form independent operable pairs *and wherein said control means for each lifting column and said operating means are configured to exchange signals via said connecting lines*.

18. The lifting device as claimed in claim 17, wherein *each of the lifting columns includes a serial number and wherein* the adjusting members mutually associate determined lifting columns by recording in the control means the respective serial numbers of the mutually associated lifting columns.

* * * * *